US005201809A

United States Patent [19]

Miura

[11] Patent Number: 5,201,809

[45] Date of Patent: Apr. 13, 1993

[54] APPLICATOR FOR COSMETICS

[75] Inventor: Akiyoshi Miura, Yokohama, Japan

[73] Assignee: Shinwa-Seisakusho Co., Ltd., Yokohama, Japan

[21] Appl. No.: 858,640

[22] Filed: Mar. 27, 1992

[30] Foreign Application Priority Data

Apr. 9, 1991 [JP] Japan ..... 3-76424

[51] Int. Cl.[5] ..... A45D 40/26

[52] U.S. Cl. ..... 132/218

[58] Field of Search ..... 132/320, 216, 218; 401/127, 129

[56] References Cited

U.S. PATENT DOCUMENTS

| | | | |
|---|---|---|---|
| 2,138,319 | 11/1938 | Bilbrey | 401/127 |
| 2,635,271 | 4/1953 | Auten | 401/127 |
| 2,783,489 | 3/1957 | Bogoslowsky | 401/127 |
| 4,313,686 | 2/1982 | Proffer | 401/127 |
| 4,705,053 | 11/1987 | Goncalves | 132/218 |
| 4,917,520 | 4/1990 | Reid | 401/127 |
| 5,096,320 | 3/1992 | Norman et al. | 401/127 |

*Primary Examiner*—Gene Mancene
*Assistant Examiner*—Thomas Price
*Attorney, Agent, or Firm*—Cushman, Darby & Cushman

[57] ABSTRACT

A cosmetic applicator, includes a container, having an opening provided with an external thread, and a cap assembly for capping the container opening. The cap assembly includes an internal thread engageable with the external thread, a shaft extending from the opening to the interior of the container, and a cosmetic applicating member disposed at an end of the shaft. The cap assembly further includes an outer cylindrical portion of which the inner surface is provided with the internal thread engageable with the external thread of the opening of the container and a mechanism for allowing the applicating member to be moved downwardly in the container to access cosmetic after the cap assembly has been unscrewed from the container. The mechanism includes an inner plug disposed around the shaft so that the shaft is slidable along the shaft direction but not rotatable relative to the cap assembly. The inner plug contains a spring mechanism.

5 Claims, 7 Drawing Sheets

APPLICATOR FOR COSMETICS

FIELD OF THE INVENTION

The present invention is directed to a cosmetics applicator.

BACKGROUND OF THE INVENTION

Conventional cosmetics applicators will be described by referring to FIGS. 7 and which show a cosmetics applicator for mascara. The mascara applicator includes cap 3, having integral shaft portion 4, and container 1, having opening portion 2. Shaft portion 4 has brush 5 at its end (or tip) portion. External thread (or male thread) portion 2*a* is formed on the outside of opening portion 2, and internal thread (or female thread) portion 3*a* is formed in the inside of cap 3. Opening portion 2 is closed off by cap 3 when thread portions 2*a* and 3*a* have been engaged. Shaft portion 4 extends into container 1 so that brush 5 nears the bottom of container 1, thereby facilitating contact with the mascara.

The mascara applicator further includes inside plug 6 mounted to opening portion 2. Inside plug 6 has wiper 7 located at its lower end portion. Wiper 7 scrapes off mascara from shaft portion 4, as it is withdrawn from container 1, thereby cleaning the shaft. Inside plug 6 also wipes away excess mascara from brush 5, thereby providing an appropriate amount of mascara on brush 5 for applicator use.

A problem exists with conventional applicators, however, when the amount of mascara remaining in container 1 is relatively low. For example, as shown in FIG. 7, the level of mascara L is too low to effectively contact brush 5. More specifically, when cap 3 is removed from container 1 for applicator use and brush 5 is then reinserted into container 1 to obtain additional mascara, brush 5 does not reach mascara level L because of length h of thread portion 2*a*, as shown in FIG. 8.

In the conventional applicators described above, the container must be shaken to insure that mascara contacts brush 5, when the level of mascara in the container is low. On the other hand, cap 3 can be screwed onto container 1 so that thread portions 2*a* and 3*a* are engaged with each other and shaft portion 4 is moved down a distance corresponding to length h of thread portion 2*a*, so that brush 5 can again contact the mascara. In this case, however, cap 3 must be in turn screwed onto and unscrewed from container 1 each time mascara is needed from the bottom of the container. Such operations cause handling difficulties. Therefore, conventional containers tend to be disposed or thrown away without using all of the mascara remaining in the containers.

SUMMARY OF THE INVENTION

An object of the present invention, in view of the problems encountered in the prior art, is to provide a cosmetic applicator which conveniently accesses the cosmetic in the container, even when the level of the cosmetic in the container is relatively low.

The present invention is directed to a cosmetic applicator which includes a means or mechanism for accessing even low levels of cosmetic in the container. In particular, a cosmetic applicator includes: a container having an opening with an external thread; and a cap assembly capable of being mounted to the container to cover the opening. The cap assembly includes: (1) an outer member, (2) an inner plug with an internal thread engageable with the external thread of the container, and (3) a shaft member fixedly secured to the outer member and slidably secured to the inner plug. The shaft member, which extends into the container, includes a cosmetic applicating brush disposed at one end. The inner plug includes the means or mechanism by which low levels of cosmetic in the container can be accessed. The inner plug is disposed to surround part of the shaft member so that the shaft member is slidable along the shaft direction within the inner plug but not rotatable relative to the inner plug.

In the presently preferred exemplary embodiment of the invention, the inner plug contains spring regions which serve to allow the shaft member, which is secured to the outer member, to be moved downwardly against the tension of the spring regions by pressing on the outer member. Accordingly, the inner plug provides a sliding stroke for the shaft member sufficient to lower the end of the cosmetic applicating member to a position near to the inner bottom of the container. More particularly, when the cap assembly has been unscrewed from the container and is pushed downwardly against the urging force of the spring regions the shaft member is moved downwardly so that the brush contacts the cosmetic at the bottom of the container.

In accordance with one embodiment of the present invention, the inner plug and spring regions constitute an integrally molded synthetic resin member. In accordance with another embodiment, a spring, separate and distinct from the inner plug, is disposed between the shaft member and the inner plug.

In still another embodiment of the present invention the container is shaped to concentrate low levels of cosmetic in a region which facilitates access by the brush.

DETAILED DESCRIPTION OF THE INVENTION

Figure 1:
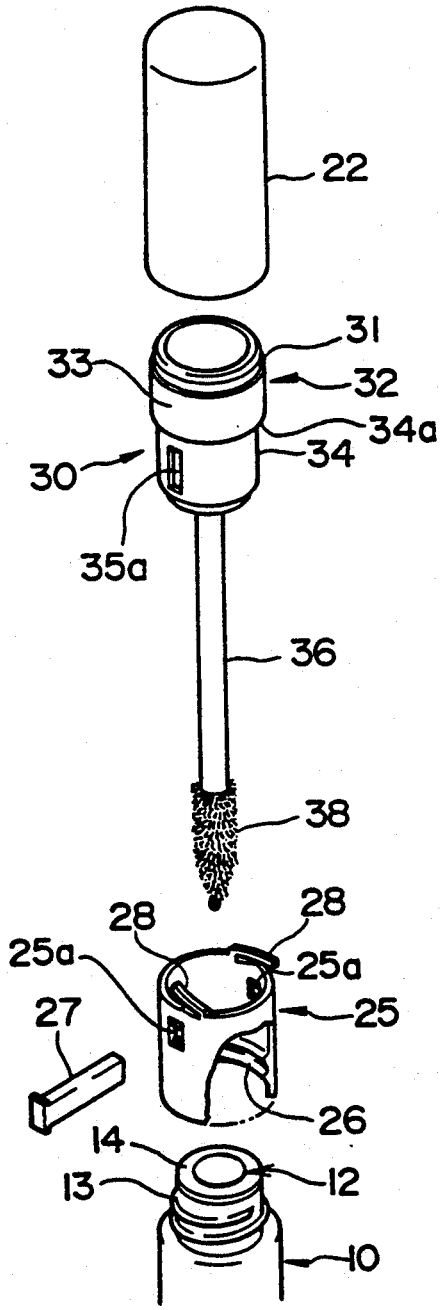
FIG. 1 shows a schematic exploded perspective view of a cosmetic applicator.

The present invention will now be described with reference to the accompanying drawings.

FIGS. 1 to 5 show a cosmetic applicator in accordance with the present invention. In these figures, reference numeral 10 denotes a cylindrical container for mascara which has an opening 12 at its upper end portion. Opening 12 is smaller than the inside diameter of container 10, and external thread portion 13 is formed on the outer periphery of container 10 adjacent to opening 12. Cylindrical inside plug 14, which has great flexibility, is inserted into container 10 through opening 12. At the end portion of inside plug 14 which extends into container 10, there is provided wiper 15 having a relatively small diameter.

Reference numeral 20 denotes a cap assembly which includes outer cylindrical member 22, inner plug 25, shaft member 30 and key 27. Shaft member 30 is fixedly secured to outer cylindrical member 22 and slidably secured to inner plug 25 by key 27. More specifically, shaft member 30 having a large-diameter portion 33 at end portion 32 is integrally fitted into the inside of outer cylindrical member 22. At the inner peripheral surface of the top portion of outer cylindrical member 22, there is formed serration groove 23 extending along the shaft direction. Large-diameter portion 33 of shaft member 30 is press-fitted into outer cylindrical member 22, and the serration groove 23 cuts into the side of large-diameter portion 33 so that outer cylindrical member 22 is integrally fixed to shaft member 30. Reference numeral 24 denotes a stepped portion formed in the inner periphery of the top portion of outer cylindrical member 22, and reference numeral 31 denotes a stepped portion of shaft member 30. Stepped portions 24 and 31 function as a reference point for determining the insertion position at which shaft member 30 is inserted into the inside of outer cylindrical member 22.

Shaft member 30 comprises in order, from top to bottom, large-diameter portion 33, small-diameter portion 34, shaft portion 36 and brush 38. Wiper 15 scrapes mascara attached to shaft portion 36, thereby cleaning shaft portion 36, when it is withdrawn from container 10. Wiper 15 also wipes mascara attached to brush 38, disposed at the end of shaft portion 36, thereby providing an appropriate amount of mascara on brush 38, when shaft portion 36 is withdrawn from container 10.

Between large-diameter portion 33 and shaft portion 36 there is formed small-diameter portion 34, which has a diameter slightly smaller than the diameter of large diameter portion 33. Around small-diameter portion 34 is disposed inner plug 25. Inner plug 25 has an internal thread portion 26 which engages with external thread portion 13 of container 10. The inner plug 25 is typically comprised of a synthetic resin.

On oppositely faces surfaces of inner plug 25 there are formed a pair of rectangular openings 25*a*. In small-diameter portion 34 there are formed a pair of rectangular slots 35*a*, having the same width as those of openings 25*a*, but longer lengths extending along the shaft direction. Key 27 is inserted through openings 25*a* and 35*a* so as to couple inner plug 25 and shaft member 30 together. As a result of rectangular slots 35*a* being longer along the shaft direction than openings 25*a* but having the same width as openings 25*a*, shaft member 30 is slidably disposed within inner plug 25, while the rotation of shaft member 30 is prevented relative to inner plug 25. More specifically, key 27 is slidable in slots 35*a* of inner plug 25 and therefore shaft member 30 is slidable along the shaft direction. However, since key 27 is also engaged with slots 35*a*, shaft member 30 cannot be rotated relative to inner plug 25.

At the upper end portion of inner plug 25, a pair of spring regions 28, which function as a compression spring, are formed to project or protrude obliquely upward. Spring regions 28 can be integrally formed with inner plug 25 from synthetic resin. Inner plug 25 having spring regions 28 can be molded as one part. When shaft member 30, inner plug 25 and outer cylindrical member 22 are assembled, spring regions 28 are press-contacted to stepped end surface 34*a* disposed between large-diameter portion 33 and cylindrical portion 34 of shaft member 30. Accordingly, when inner plug 25 rests on container 1 (after it has been unscrewed from container 10) spring regions 28 urge shaft member 30 upwardly or out of container 10. However, since shaft member 30 is slidable relative to inner plug 25, shaft member 30 can be moved downwardly against the force of spring regions 28.

Figure 4:
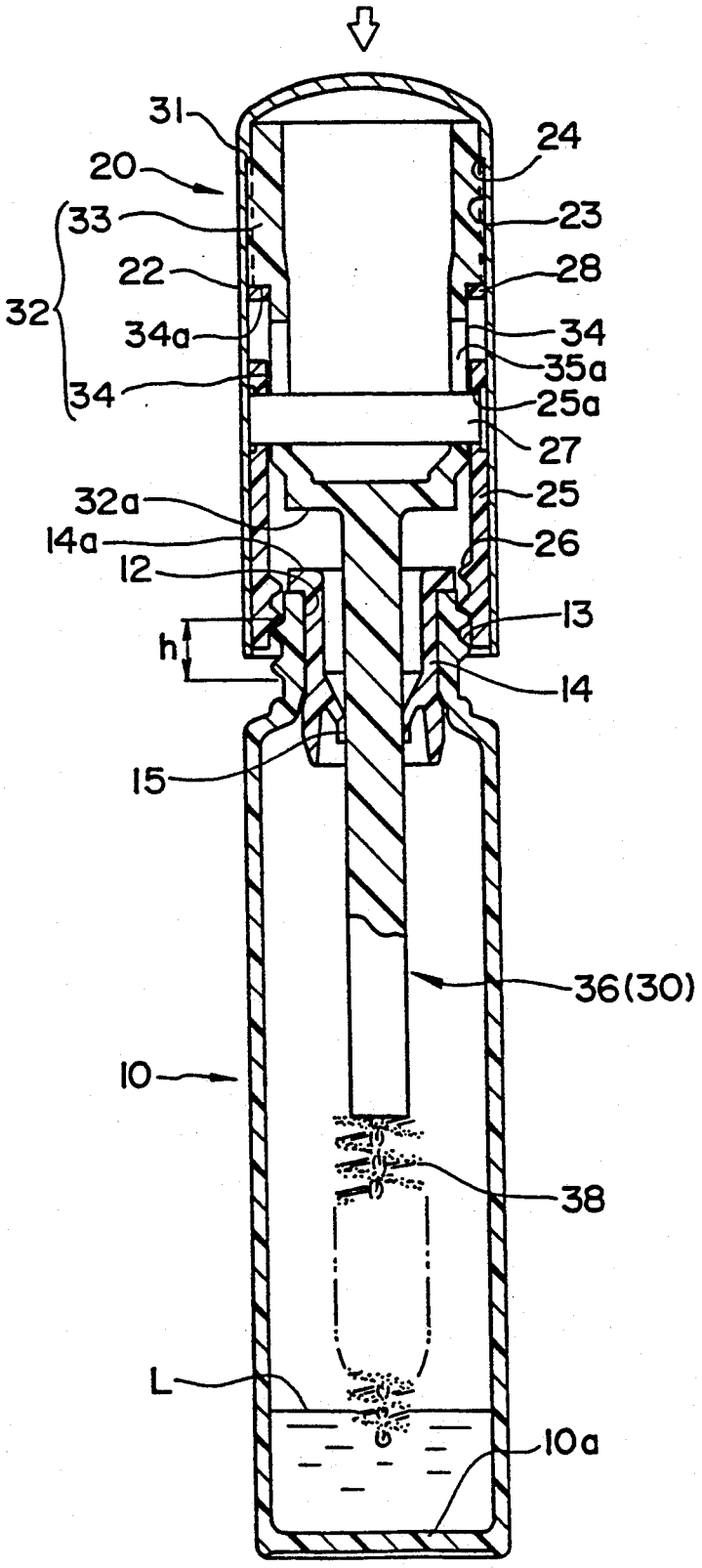
FIG. 4 shows a schematic longitudinal sectional view of the cosmetic applicator, when the cap assembly has been untwisted from the container and merely rests atop the container.
Figure 5:
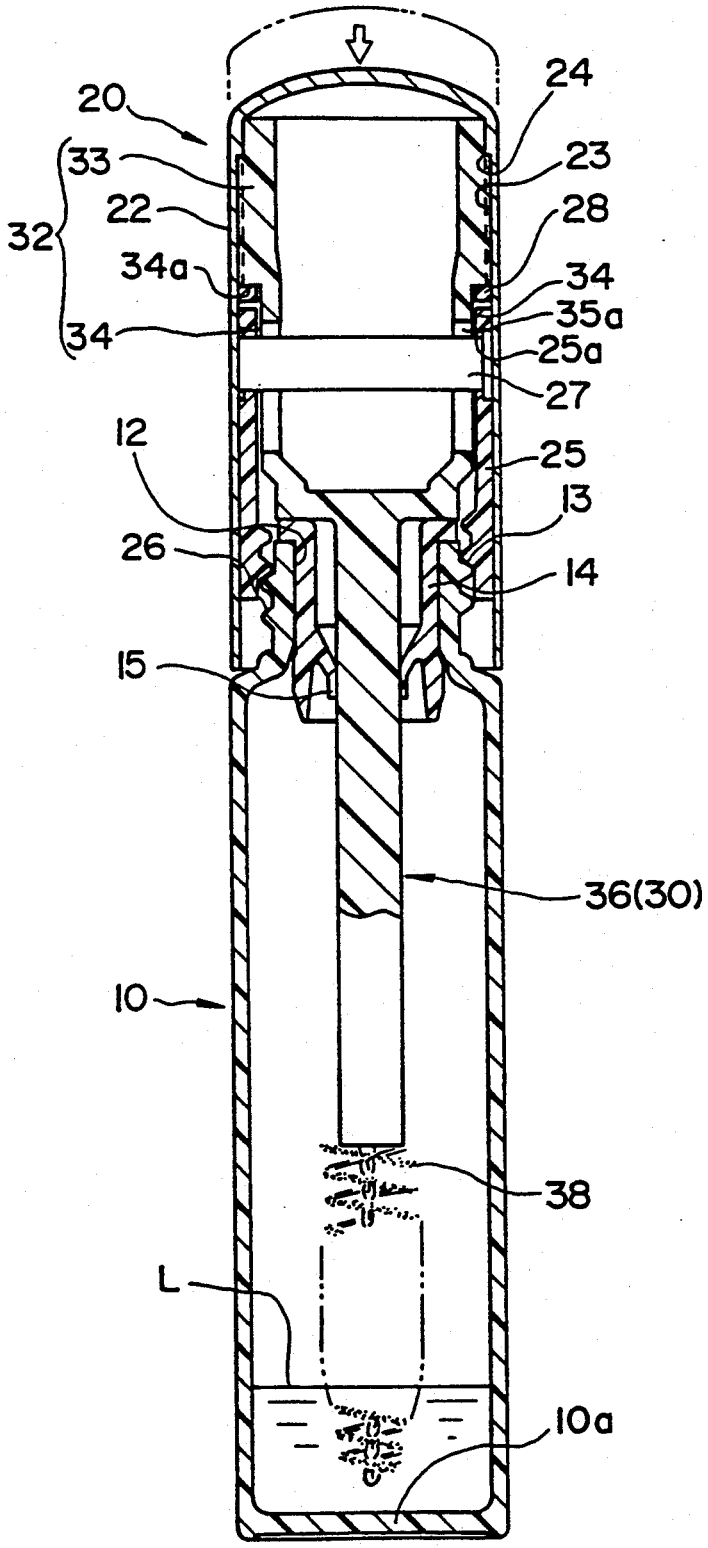
FIG. 5 shows a schematic longitudinal sectional view of the cosmetic applicator, when the untwisted cap assembly, shown in FIG. 4, has been pushed downward.

More specifically, as shown in FIG. 4, when cap assembly 20 has been unscrewed from cylindrical container 10 and only rests on container opening portion 12, the head portion of cap assembly 20 can be pressed downwardly against the spring force provided by spring regions 28, as shown by the arrow. Shaft member 30 integrally disposed with outer cylindrical member 22 is thereby lowered with respect to inner plug 25, causing brush 38 to be moved downwardly near to the inner bottom surface of container 10, as shown in FIG. 5.

When cap assembly 20 is screwed onto container opening portion 12, internal thread portion 26 is urged against and engages with external thread portion 13 of opening portion 12, so that cap assembly 20 can smoothly be engaged with opening portion 12. More specifically, FIG. 4 shows cap assembly 20 unscrewed from container 10. When cap assembly 20 is rotated from the initial state shown in FIG. 4, inner plug 25 is also rotated. Since internal thread portion 26 is urged to contact with external thread portion 13 by the urging force of spring regions 28, internal thread portion 26 effectively and smoothly engages with external thread portion 13. As the engagement of internal thread portion 26 with external thread portion 13 proceeds, cap assembly 20 is lowered and the state shown in FIG. 2 occurs, wherein cap assembly 20 is clamped on opening portion 12.

If spring regions 28 are not provided then inner plug 25 may not be urged toward the container opening. Accordingly, inner plug 25 could freely slide vertically in the shaft direction within the interior of outer cylinder member 22, thereby preventing cap assembly 20 from being clamped to container 10. More specifically, when inner plug 25 merely rests on container opening portion 12 due to its own weight, cap assembly 20 can be clamped to container 10 by rotating cap assembly 20. However, absent spring regions 28, if cap assembly 20 is to be clamped to container 10 while the cosmetic container is held non-vertically, inner plug 25 will not necessarily be positioned adjacent to the cap opening and therefore internal thread portion 26 may not contact external thread portion 13. If there is no contact, then external thread portion 13 cannot be engaged with internal thread portion 26, i.e., cap assembly 20 cannot be clamped to container 10, no matter how much cap assembly 20 is rotated. As described above, spring regions 28 which have been provided for urging inner plug 25 toward the container opening are essential to the smooth engagement of cap assembly 20 with opening portion 12.

Figure 2:
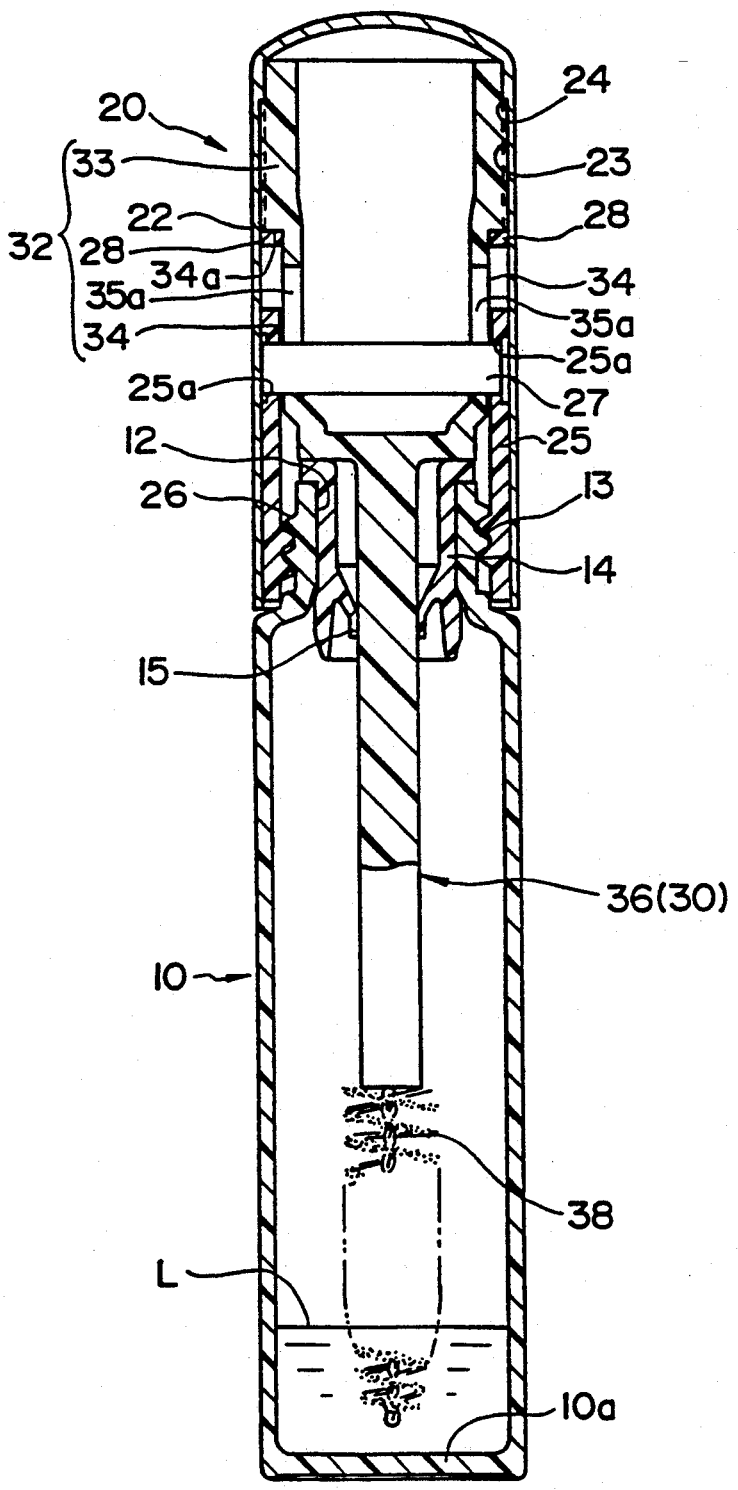
FIG. 2 shows a schematic longitudinal sectional view of the cosmetic applicator shown in FIG. 1.
Figure 3:
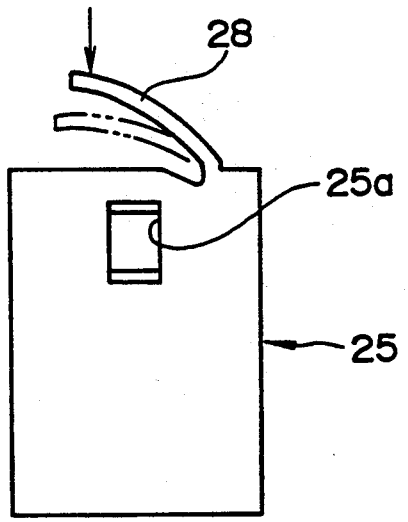
FIG. 3 shows an enlarged side view of an inner plug used in the cosmetic applicator shown in FIG. 1.

The length of shaft member 30 is sufficient so that the tip portion of brush 38 is disposed near to the inner bottom surface of container 10, when cap assembly 20 is engaged with opening portion 12 as shown in FIG. 2. As shown in FIG. 4, when the level of mascara remaining in container 10 becomes low, and when brush 38 is removed from and then again inserted into container 10 (to again access the mascara), brush 38 does not reach the mascara, but a distance (or height) therebetween remains. In the present invention, however, brush 38 can be dipped into the mascara by pressing downwardly on cap assembly 20 to lower shaft member 30, as shown in FIG. 5. Brush 38 may not be lowered any further, however, once lower end surface 32*a* of hollow base end portion 32 of shaft member 30 abuts against upper surface 14*a* of inner plug 14 (see FIG. 4).

In this embodiment, brush 38 may be lowered to a position which is the same as the position at which the cap assembly 20 is engaged with the opening portion 12. As a result, even when the level of the mascara remaining in container 10 is low, the mascara may easily be attached to brush 38 by only lightly pressing downwardly on cap assembly 20. Therefore, all of the mascara in the container may substantially be used, even when the level of the mascara remaining in the container is very low.

As described above, spring regions 28 are integrally formed with inner plug 25. However, it is also possible to use a compression coil spring, or a plate spring in the form of a ring which is provided separately from inner plug 25 and in place of spring regions 28.

Figure 6:
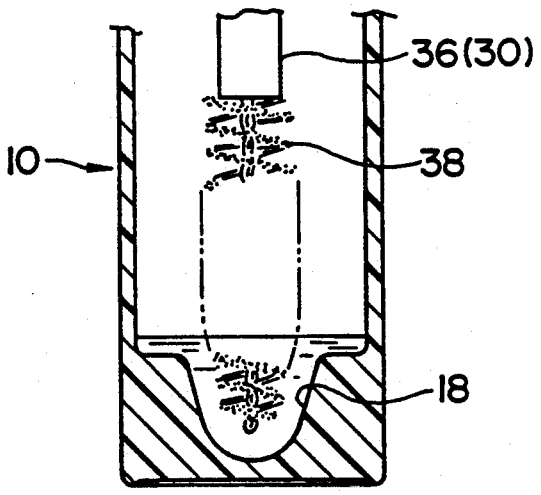
FIG. 6 shows a schematic longitudinal sectional view of the cosmetic applicator, in accordance with another embodiment of the present invention.
Figure 7:
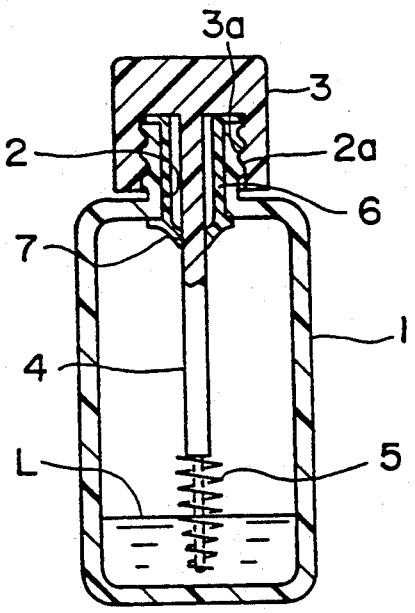
FIG. 7 (Prior Art)
FIG. 7 shows a schematic longitudinal sectional view of a conventional cosmetic applicator.
Figure 8:
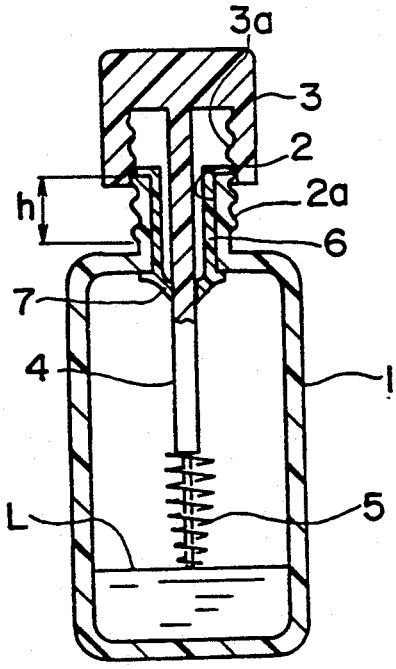
FIG. 8 (Prior Art)
FIG. 8 illustrates a problem encountered by conventional cosmetic applicators.

FIG. 6 shows a longitudinal sectional view of the mascara applicator, in accordance with another embodiment of the present invention. In this embodiment, recess 18 is formed in the bottom surface of container 10 so that it surrounds brush 38. When the level of the mascara remaining in container 10 becomes low, the mascara collects in recess 18. As a result, the mascara may be effectively used even when very low levels or amounts of mascara remain in container 10.

In the above embodiments, the present invention has been described with reference to an applicator for liquid cosmetic, but the present invention is also applicable to an applicator for powder cosmetics.

What is claimed is:

1. A cosmetics applicator comprising:

a container having an opening at one end and external threads formed in a portion of said container adjacent to the opening; and a cosmetics applicator assembly adapted for sealing the opening of said container by engaging with the external threads of said container, and adapted to access a cosmetic contained in said container, said cosmetic applicator assembly being movable from a first position to a second position further into said container when said cosmetic applicator assembly does not engage with the external threads of said container, said cosmetic applicator assembly including an outer cylindrical member, a shaft member fixedly secured at one end thereof to said outer cylindrical member and having an applicator member attached to the other end thereof, and a cylindrical inner plug having internal threads for mating with the external threads of said container, said cylindrical inner plug having spring means for facilitating downward movement of said shaft member to said second position from said first position, said cylindrical inner plug and said spring means being formed in one piece of synthetic resin, said inner plug being disposed around a portion of said shaft member.

2. An applicator as claimed in claim 1, further comprising a key member coupling said inner plug to said shaft member, said key member passing through openings in opposite side surfaces of said inner plug and through said shaft member.

3. An applicator as claimed in claim 1, wherein said container has a recess portion at a bottom interior thereof for collecting low levels of cosmetic.

4. An applicator as claimed in claim 1, further comprising an inside plug disposed in said container, said inside plug having a wiper at one end thereof for scraping cosmetic from said shaft member as it is withdrawn from said container.

5. An applicator as claimed in claim 1, wherein said applicator member includes a brush.

* * * * *